US005445452A

United States Patent [19]

Kauffman et al.

[11] Patent Number: 5,445,452

[45] Date of Patent: Aug. 29, 1995

[54] REFRIGERATOR ADJUSTABLE UTILITY COMPARTMENT/SLIDING SHELF

[75] Inventors: Michael S. Kauffman, Lincoln Township, Berrien County, Mich.; Patrick A. Braun, Ohio Township, Warrick County, Ind.; Donna J. Heacock, Henderson, Ky.; Jeffrey A. DeBoer, Ann Arbor, Mich.

[73] Assignee: Whirlpool Corporation, Benton Harbor, Mich.

[21] Appl. No.: 247,376

[22] Filed: May 23, 1994

[51] Int. Cl.[6] ..... F25D 11/00

[52] U.S. Cl. ..... 312/405.1; 312/321.5

[58] Field of Search ..... 312/405.1, 404, 350, 312/321.5; 108/93

[56] References Cited

U.S. PATENT DOCUMENTS

| | | | |
|---|---|---|---|
| 2,658,727 | 11/1953 | Eck . | |
| 2,708,565 | 4/1955 | McKirgan | 312/405.1 |
| 2,828,178 | 3/1958 | Dahlgren . | |
| 2,840,434 | 6/1958 | Moore et al. | 312/405.1 |
| 2,877,077 | 3/1959 | Robinson et al. | 312/405.1 |
| 2,898,173 | 8/1959 | Squire . | |
| 4,798,425 | 1/1989 | Armstrong et al. . | |
| 4,921,315 | 5/1990 | Metcalfe et al. . | |
| 5,193,892 | 3/1993 | Swindell . | |

*Primary Examiner*—Kenneth J. Dorner
*Assistant Examiner*—Gerald A. Anderson
*Attorney, Agent, or Firm*—Thomas J. Roth

[57] ABSTRACT

A refrigerator includes an adjustable utility compartment and sliding shelf. Particularly, the refrigerator includes a door having an inner door panel including a rear wall extending between opposite vertical sidewalls. The utility compartment is removably mounted to the inner door panel adjacent a first one of the sidewalls. A shelf trim piece extends between the sidewalls and is spaced forwardly of the panel rear wall. A storage shelf is of a length shorter than a distance between the sidewalls. The storage shelf is slidably positioned between a ledge on the panel rear wall and the shelf trim piece for slidable lateral movement between a usable storage position located between the utility compartment and a second one of the sidewalls and a non-usable retracted position beneath the utility compartment.

11 Claims, 1 Drawing Sheet

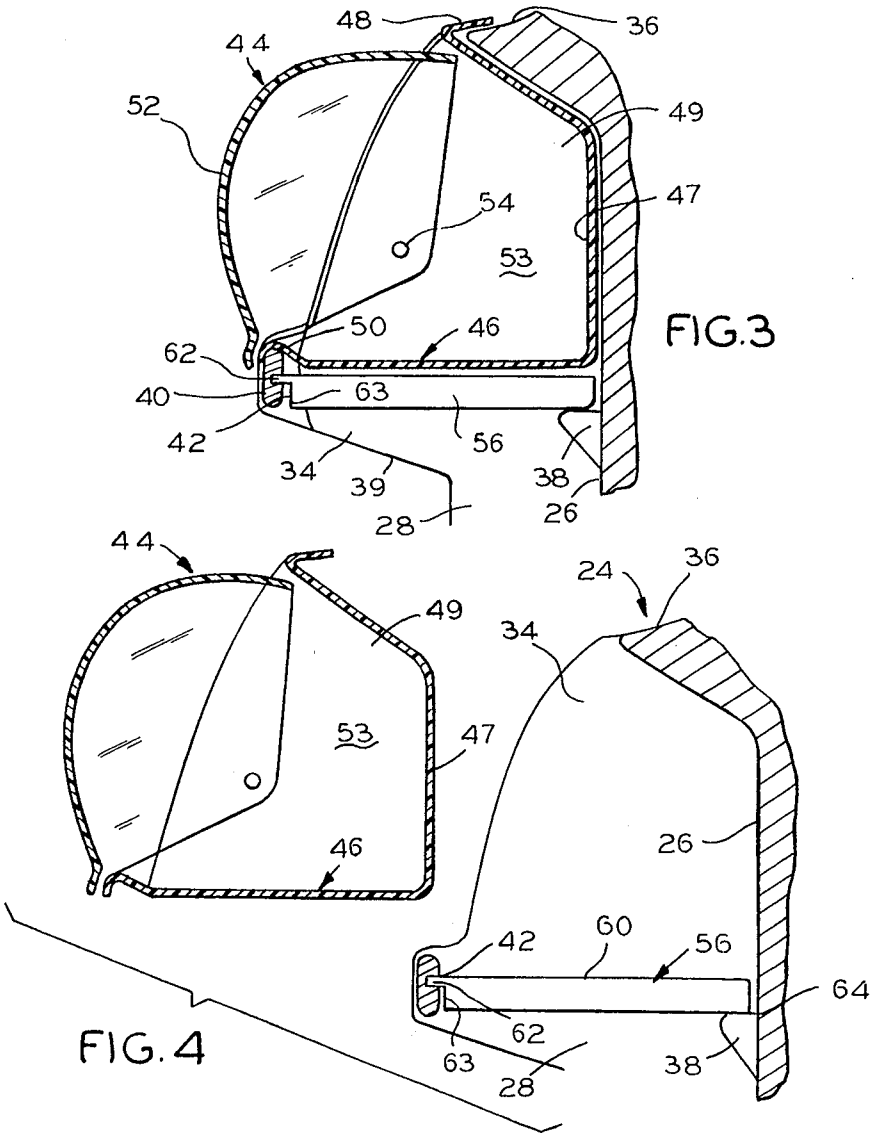
FIG.3
FIG.4
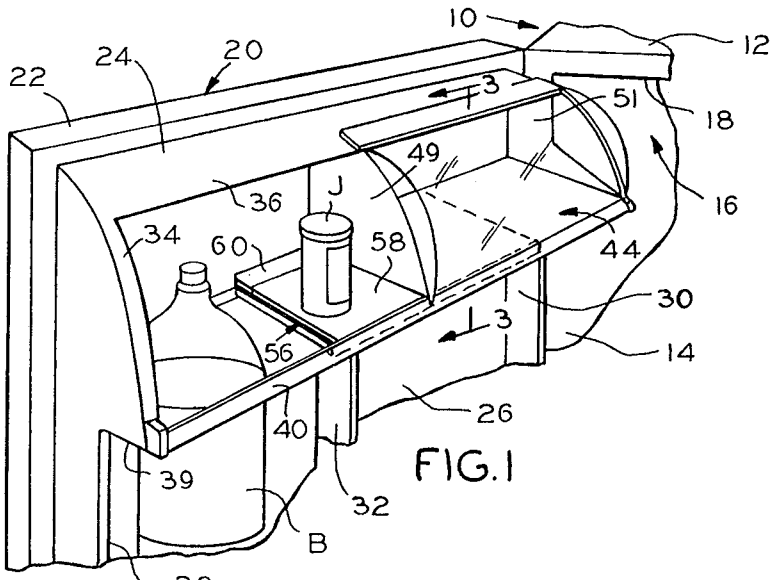
FIG.1
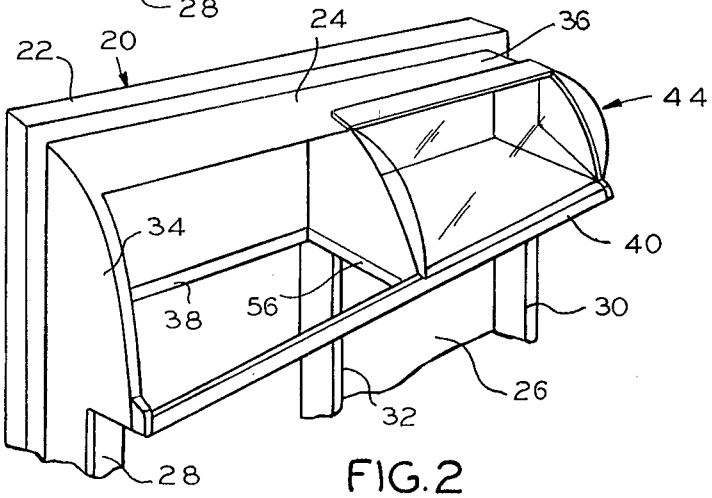
FIG.2

REFRIGERATOR ADJUSTABLE UTILITY COMPARTMENT/SLIDING SHELF

FIELD OF THE INVENTION

This invention relates generally to a refrigeration apparatus and, more particularly, to a refrigerator door including an adjustable utility compartment and sliding shelf.

BACKGROUND OF THE INVENTION

A refrigeration apparatus typically includes a cabinet having an internal storage space accessible through an access opening. A door is hingedly mounted to the cabinet for selectively closing the access opening. Known refrigeration apparatus include various systems for mounting shelves or storage bins on the door. A typical door includes a formed inner door panel including a rear wall and a plurality of vertical sidewalls. Often, one or more utility compartments for butter, margarine, eggs or other miscellaneous items are integrally formed at the top of the door panel. A plurality of vertically spaced shelves are formed in other positions on the door. Alternatively, the door might include removable shelves including a hook and ladder arrangement for selectively mounting storage bins to select desired vertical positions on the door.

The present invention is intended to provide additional storage options in connection with door shelf support systems.

SUMMARY OF THE INVENTION

In accordance with the invention, a door shelf support system includes an adjustable utility compartment and related sliding shelf.

Broadly, there is disclosed herein a door shelf support system in a refrigeration apparatus cabinet defining a storage space and having a door providing selective access to the space. The system comprises an inner door panel including a rear wall extending between opposite vertical sidewalls. A shelf trim piece extends between the sidewalls and is spaced forwardly of the panel rear wall. A storage shelf is of a length shorter than a distance between the sidewalls. Support means are operatively associated with the door panel and the trim piece for supporting the storage shelf therebetween for slidable movement between the sidewalls.

It is a feature of the invention that the support means comprises a ledge on the inner door panel extending forwardly from the rear wall for supporting a rear marginal edge of the storage shelf.

It is another feature of the invention that the ledge is integral with the inner door panel.

It is still another feature of the invention that the storage shelf includes a forwardly extending flange and the support means comprises an elongate rearwardly opening channel in the trim piece receiving the flange.

There is disclosed in accordance with another aspect of the invention a door shelf support system comprising an inner door panel including a rear wall extending between opposite vertical sidewalls. A utility compartment is mounted to the inner door panel adjacent a first one of the sidewalls. A shelf trim piece extends between the sidewalls and is spaced forwardly of the panel rear wall. A storage shelf is of a length shorter than a distance between the sidewalls. Support means are operatively associated with the door panel and the trim piece for supporting the storage shelf therebetween for slidable lateral movement between a usable storage position located between the utility compartment and a second one of the sidewalls and a non-usable retracted position beneath the utility compartment.

It is a feature of the invention that the utility compartment is removably mounted to the inner door panel.

It is another feature of the invention that the utility compartment includes an enclosure having a top flange received on a top wall of the inner door panel and a front flange received on the trim piece.

It is still another feature of the invention that the utility compartment is slidably mounted to the inner door panel between the sidewalls.

Further features and advantages of the invention will be readily apparent from the specification and from the drawing.

BRIEF DESCRIPTION OF THE DRAWING

FIG. 1 a partial perspective view of a refrigerator including a door shelf support system embodying the invention, with a sliding shelf in a usable storage position FIG. 2 is a view similar to that of FIG. 1, with the sliding shelf in a retracted position;

FIG. 3 is a sectional view taken along the line 3—3 of FIG. 1; and FIG. 4 is an exploded view similar to the view of FIG. 3.

DETAILED DESCRIPTION OF THE INVENTION

Referring to FIG. 1, a refrigeration apparatus, such as a refrigerator/freezer 10, includes a cabinet 12 having an improved door shelf support system. The cabinet 12 has an internal liner 14 defining a refrigerated storage space 16. The storage space 16 is accessible through an access opening 18. A door 20 selectively closes the access opening 18.

The door 20 includes an outer door panel or shell 22 and an inner door panel or liner 24. The outer shell 22 is typically formed of metal in the configuration of a parallelepiped. The liner 24 is of unitary molded plastic construction. The liner 24 is secured to the door panel 22 in any known manner.

The liner 24 includes a rear wall 26 extending between opposite vertical end sidewalls 28 and 30. A central vertical sidewall or projection 32 is provided midway between the end sidewalls 28 and 30. Each of the sidewalls 28, 30 and 32 extends forwardly from the rear wall 26. The sidewall 28 is enlarged at an upper end 34 proximate a top wall 36. A horizontal ledge 38 extends forwardly from the rear wall 26 below the top wall 36. The ledge 38 is integrally formed in the liner 24. The ledge 38 is spaced below the top wall 36 a select distance to be at a vertical position corresponding to a bottom edge 39 of the sidewall enlarged upper end 34.

A shelf trim piece 40 extends between the sidewalls 28 and 30 and is connected by any known means proximate the bottom edge 39 of the enlarged tipper end 34 of the sidewall 28 and a similar upper end (not shown) of the second sidewall 30. As a result, the trim piece 40 is positioned vertically just above the ledge 38 and is forwardly therefrom. The shelf trim piece 40 includes an elongate, horizontal rearwardly opening channel 42.

A utility compartment 44 is removably mounted to the inner door panel 24. The utility compartment 44 includes a formed enclosure 46 having a generally U-shaped wall 47 connected between an opposite top flange 48 and a front flange 50. End walls 49 and 51 are also connected to the wall 47 to define a storage space 53. The enclosure 46 is mounted to the door panel as by resting the top flange 48 on the liner top wall 36 and the front flange 50 on the shelf trim piece 40, as illustrated. The enclosure 40 can be selectively positioned at any horizontal position between the sidewalls 28 and 30, although the enclosure 46 is normally positioned proximate one of the vertical sidewalls, such as the sidewall 30 as illustrated in FIGS. 1 and 2. The utility compartment 44 also includes a hinge access cover 52 hingedly mounted to the enclosure as at 54, as is well known.

In the illustrated embodiment of the invention, the utility compartment 44 is of a length approximately half of the horizontal distance between the sidewalls 28 and 30 so that it in use it extends between the center sidewall 32 and one of the vertical sidewalls 28 and 30. In accordance with the invention, the horizontal space between the utility compartment 44 and the other of the sidewalls 28 or 30 can be selectively occupied by a slidable storage shelf 56 in accordance with the invention.

The storage shelf 56 is of unitary molded plastic construction including a bottom wall 58 surrounded by a peripheral wall 60. A flange 62 extends forwardly from a front wall 63 of the peripheral wall 60, see FIGS. 3 and 4.

The shelf 56 is slidably mounted to the inner door panel 24 as by resting the sliding shelf 56, adjacent a rear marginal edge 64, on the ledge 38. The front flange 62 is slidably received in the shelf trim piece channel 42. As such, the door panel 24 and trim piece 40 support the storage shelf 56 therebetween for slidable movement between the sidewalls 28 and 30. With particular reference to FIGS. 1 and 2, the shelf 56 is mounted for slidably lateral movement between a usable storage portion located between the utility compartment 44 and one of the sidewalls, such as the sidewall 28, as illustrated in FIG. 1, and a non-usable retracted position beneath the utility compartment, as illustrated in FIG. 2. Positioning the sliding shelf 56 in the retracted position allows more height for tall items placed on a shelf therebelow. For example, the shelf 56 is illustrated in FIG. 1 partially in the storage position and partially in the retracted position (see phantom line). This provides room for taller items, such as a bottle B resting on a lower shelf (not shown), while not loosing shelf space for smaller items, such as a jar J resting on the shelf 56. The shelf 56 can be selectively positioned at any position between the sidewalls 28 and 30.

In accordance with the invention, both the utility compartment 44 and sliding shelf 56 are removable for cleaning. Moreover, the slidable positioning of each provides numerous options for shelf configuration according to particular storage requirements at any given time.

The illustrated embodiment of the invention is intended to illustrate the broad inventive concepts comprehended by the invention.

We claim:

1. In a refrigeration apparatus cabinet defining a storage space and having a door providing selective access to said space, a door shelf support system comprising:

an inner door panel including a rear wall extending between opposite vertical sidewalls;

a shelf trim piece extending between said sidewalls and spaced forwardly of said panel rear wall;

a storage shelf of a length shorter than a distance between said sidewalls; and support means operatively associated with said door panel and said trim piece for supporting said storage shelf therebetween for slidable movement between said sidewalls.

2. The door shelf support system of claim 1 wherein said support means comprises a ledge on said inner door panel extending forwardly from said rear wall for supporting a rear marginal edge of said storage shelf.

3. The door shelf support system of claim 2 wherein said ledge is integral with said inner door panel.

4. The door shelf support system of claim 1 wherein said storage shelf includes a forwardly extending flange and said support means comprises an elongate rearwardly opening channel in said trim piece receiving said flange.

5. In a refrigeration apparatus cabinet defining a storage space and having a door providing selective access to said space, a door shelf support system comprising:

an inner door panel including a rear wall extending between opposite vertical sidewalls;

a utility compartment mounted to said inner door panel adjacent a first one of said sidewalls;

a shelf trim piece extending between said sidewalls and spaced forwardly of said panel rear wall;

a storage shelf of a length shorter than a distance between said sidewalls; and support means operatively associated with said door panel and said trim piece for supporting said storage shelf therebetween for slidable lateral movement between a useable storage position located between said utility compartment and a second one of said sidewalls and a non-useable retracted position beneath said utility compartment.

6. The door shelf support system of claim 5 wherein said support means comprises a ledge on said inner door panel extending forwardly from said rear wall for supporting a rear marginal edge of said storage shelf.

7. The door shelf support system of claim 6 wherein said ledge is integral with said inner door panel.

8. The door shelf support system of claim 5 wherein said storage shelf includes a forwardly extending flange and said support means comprises an elongate rearwardly opening channel in said trim piece receiving said flange.

9. The door shelf support of claim 5 wherein said utility compartment is removably mounted to said inner door panel.

10. The door shelf support system of claim 9 wherein said utility compartment includes an enclosure having a top flange received on a top wall of said inner door panel and a front flange receivable on said trim piece.

11. The door shelf support of claim 5 wherein said utility compartment is slidably mounted to said inner door panel between said sidewalls.

* * * * *